United States Patent [19]

Renken

[11] Patent Number: 4,603,309

[45] Date of Patent: Jul. 29, 1986

[54] SWITCHING HIGH SPEED DIGITAL PULSES

[75] Inventor: Gerald W. Renken, Edina, Minn.

[73] Assignee: Honeywell Inc., Minneapolis, Minn.

[21] Appl. No.: 613,948

[22] Filed: May 25, 1984

[51] Int. Cl.[4] ..... H01P 1/10

[52] U.S. Cl. ..... 333/101; 333/104; 333/238; 335/4

[58] Field of Search ..... 333/101, 104, 161, 238; 307/244; 335/4, 5; 361/400, 404, 406, 409

[56] References Cited

U.S. PATENT DOCUMENTS 3,385,732 5/1968 Curran ..... 361/404 X 3,581,250 5/1971 Eichert et al. ..... 333/161

3,778,643 12/1973 Jaffe ..... 333/161 X

*Primary Examiner*—Paul Gensler

*Attorney, Agent, or Firm*—George A. Leone, Sr.

[57] ABSTRACT

The method of distributing a signal from an input conductor to a plurality of relay terminals at known locations in the plane of a circuit board which comprises meandering said input conductor to intersect said terminals in succession while avoiding other relay contacts. The meandering conductor path gives this type of relay switching system the ability to maintain a switching system characteristic impedance, $Z_0$, in a simple, cost effective manner.

3 Claims, 4 Drawing Figures

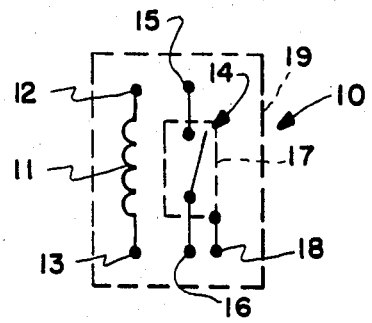
Fig. 1
Fig. 2
(PRIOR ART)
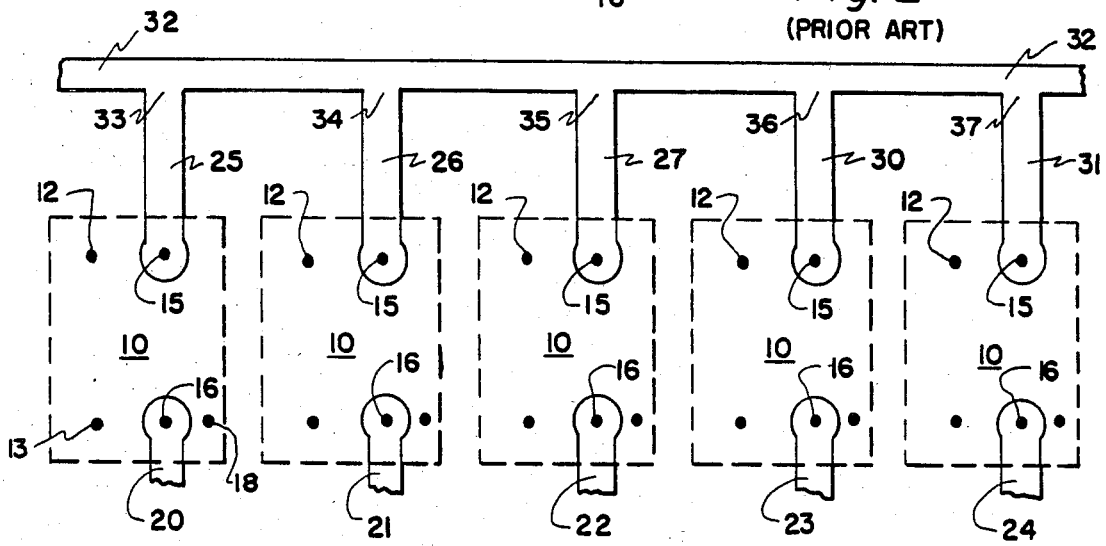
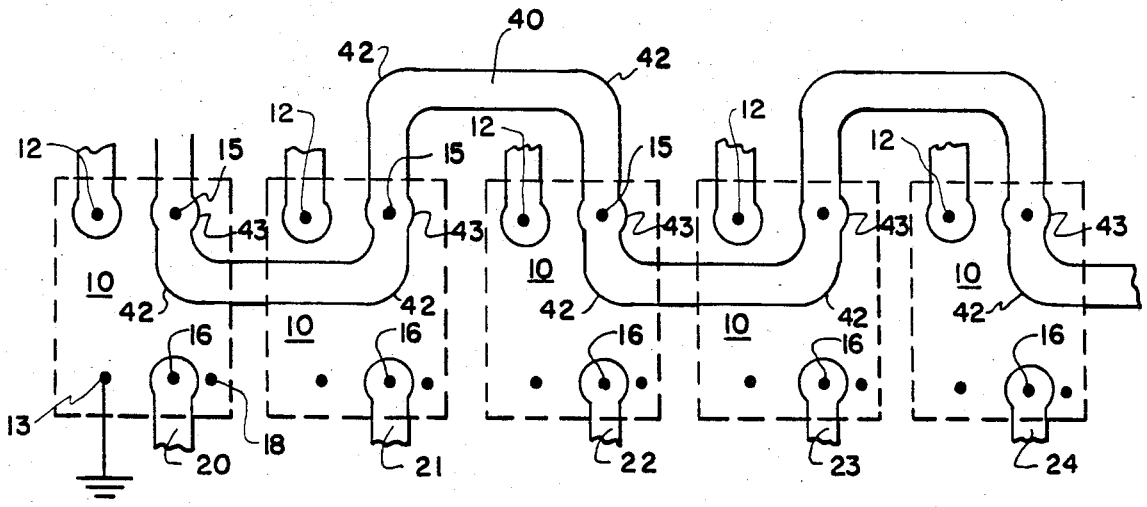
Fig. 3

SWITCHING HIGH SPEED DIGITAL PULSES

FIELD OF THE INVENTION

This invention relates to the field of electrical engineering, and particularly to a switching arrangement for distributing an electrical signal, comprising high speed digital pulses, to selected circuits without significant distortion.

BACKGROUND OF THE INVENTION

In electrical engineering it is frequently desirable to be able to distribute a voltage to any selected one of a plurality of circuits, the voltage in question being supplied on an input conductor and being distributed to a desired output conductor by manual switching or by relay operation. It is well known, for example, to tap an input line at successive points therealong and connect the taps through independent switching contacts to independent output circuits, as in the simple case of several doorbells energized from a common battery or transformer through independent push buttons.

When the signal to be distributed is more complex, as for example comprising a train of essentially square wave pulses having high repetition frequencies and short rise and fall times, the problem becomes more complicated if signal distortion is to be avoided. Here it is desirable to use feed lines having appropriate known characteristic impedances. Concentric cables of various known characteristic impedances are known, and relays are also known which operate successfully to switch signals of the type described without distortion, but such relays are expensive and the process of connecting a common input conductor to numerous relays using coaxial cables is intricate and time consuming, as is any repair procedure later found necessary. Relays for use with coaxial cable also take up more space, since they must be so located that their terminals are accessible for attaching the cable.

Another form of feedline useable for distribution of signals made up of digital pulse trains comprises a strip transmission line or "stripline". This feedline arrangement places the feedline in the center of a sandwich structure, the feedline taking the shape of a thin, ribbon conductor. The sandwich, of thickness "b" consists of two dielectric sheets, each of thickness b/2.

The ribbon conductor of width W runs between the two dielectric sheets. The outside of each dielectric sheet is totally clad with copper to form a groundplane. $Z_0$, the characteristic impedance of such a line, when unloaded, is determined by the dielectric constant and thickness of the dielectric sandwich, b, and the width of the ribbon conductor, W.

Inexpensive, compact relays have been designed for use with printed circuit boards. These relays have a construction characterized by a "footprint" or planar arrangement of connection points when the relay is secured to the strip-line conductor within the stripline circuit board. The conductors of the board must be provided with solder pads for connection to the relay contacts. The solder pads have lumped capacitances which make the loaded characteristic impedances of the striplines different from their known unloaded values. It is also known that the relay itself, when tapping into such a line, introduces a further lumped capacitance and causes more energy reflection, so that altogether the signal wave form is considerably degraded in its pulse width, rise time, and fall time.

BRIEF SUMMARY OF THE INVENTION

I have invented an arrangement whereby pulsed signals on an input conductor may be distributed to a selected one of a plurality of output conductors without significant distortion or loss of power, and without requiring a plurality of coaxial cables and a plurality of the expensive relays designed for use with such cables.

The present invention comprises an arrangement in which a "meander line" is used in a strip-line construction as a substitute for a direct line with a plurality of spaced taps, and in which it is possible to determine what should be the unloaded characteristic impedance of a line suitable to result in a desired characteristic impedance after loading, whereby pulse distortion and power loss by reflection are minimized.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals identify corresponding parts throughout the several views, FIG. 1 is a schematic showing of the "footprint" of a relay usable in the practice of the invention, FIG. 2 schematically shows in bottom view a prior art arrangement for distributing a signal to a selected one to a plurality of circuits, FIG. 3 is a schematic showing in bottom view of a signal distribution arrangement according to the invention and FIG. 4 is a perspective drawing which shows an exploded view of relays mounted on a printed circuit board of strip-line construction wherein the feed line is in the meander-line configuration of the invention.

DETAILED DESCRIPTION OF THE PREFERRED EMBODIMENT

Figure 4:
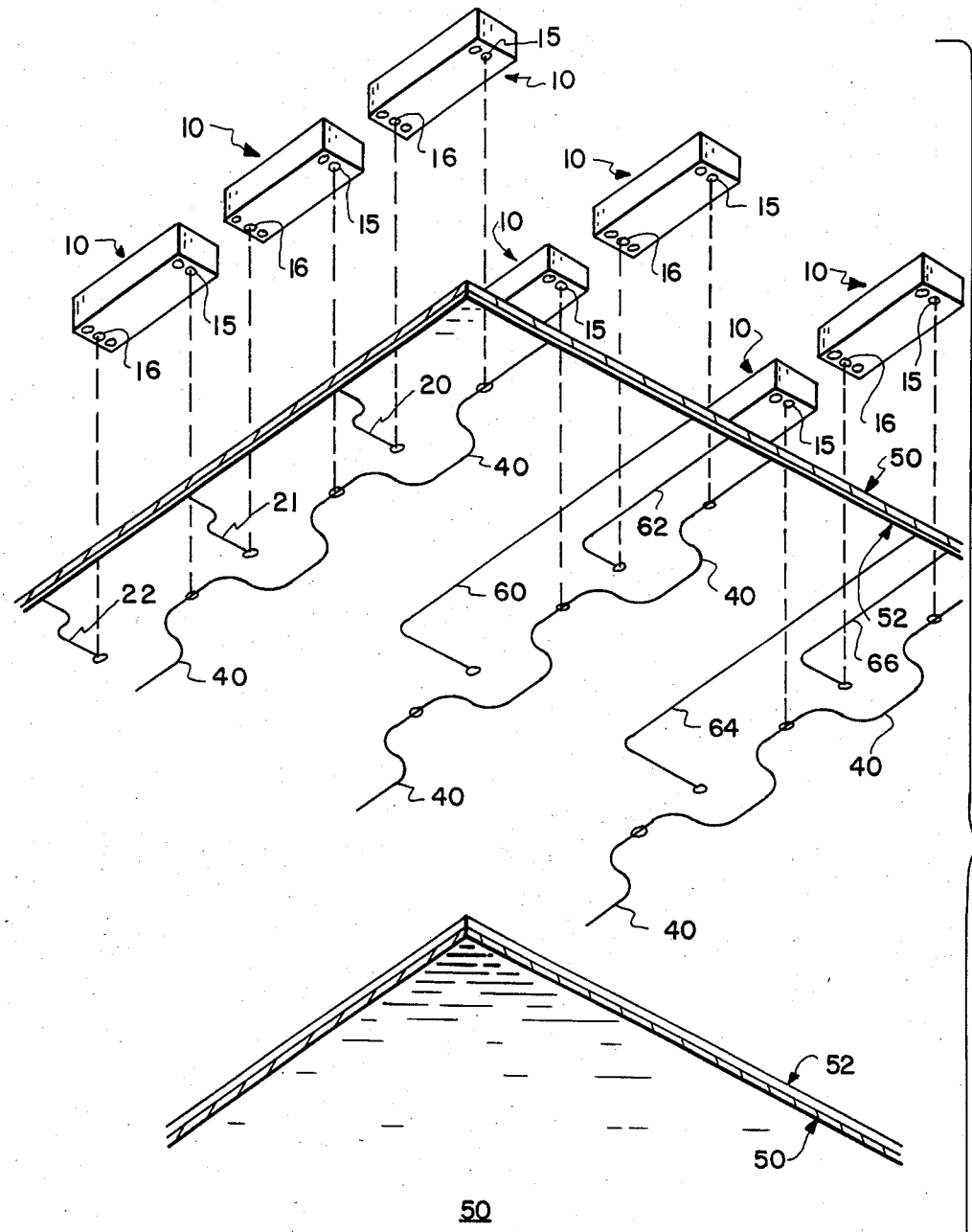

Turning now to FIG. 1, a relay 10 suitable for switching use in the practice of the invention is shown in "footprint" form to comprise a winding 11 having terminals 12 and 13 and actuating a set of contacts 14 having terminals 15 and 16, the contacts being enclosed in a electrostatic shield 17 having a terminal 18. The outline of the relay is suggested by the broken line 19, which represents the space occupied by the relay and the locations of its various terminals.

FIG. 2 schematically shows a plurality of relays 10 mounted on a strip-line board in a typical equidistant, space-saving arrangement. The switching terminals 16 are connected to output stripline conductors 20, 21, 22, 23, and 24 respectively, and the switching terminals 15 are connected to stripline conductors 25, 26, 27, 30, and 31 respectively, which are tapped to a common input stripline conductor 32 at 33, 34, 35, 36, and 37, respectively.

It will be apparent that each tap, as tap 33 for example, comprises a discontinuity in conductor 32, and results in energy reflection and consequent power loss and signal distortion. The taps themselves have the same characteristic impedance as conductor 32 but acting together, cause the characteristic impedance of stripline conductor 32 to change to a lower value. This action modifies the signal carrying properties of the assembly as a whole.

FIG. 3 schematically shows a plurality of relays as in FIG. 2, but interconnected in accordance with the invention. Relays 10 have their terminals 16 connected to stripline conductors 20, 21, 22, 23, and 24 as before. Contacts 15 are not, however, connected to separate taps. The input stripline conductor 40 is a "meander" conductor, and is configured to avoid terminals 12, 13, 16, and 18 of the relay and to pass directly under the terminals 15 of successive relays for connection directed thereto at solder pads 43. The meanders are curves 42 of such radius as to avoid significantly affecting a signal moving along the meandering stripline conductor. It is to be noted that there is no change in direction of line 40 at points of connection with terminals 15.

Each relay contact 15 has a determinable lumped capacitance $C_1$, and at each connection the line is provided with a solder pad 43 also of known lumped capacitance $C_2$. The unloaded characteristic impedance $Z_0$ of a meander line 40 can be determined by standard procedures. When these routine calculations are performed $C_0$, the distributed capacitance for this meander line, can also be determined. If the common distance d between the successive solder pads 43 is known, the loaded impedance $Z_L$ of an input line designed according to the invention is given by the equation:

$$Z_L = \frac{Z_0}{\sqrt{1 + \frac{(C_1 + C_2)/d}{C_0}}}$$

From the equation it is possible to determine what unloaded impedance $Z_0$ is necessary if that line, when loaded, is to have the desired loaded impedance $Z_L$, so that this meander line can be designed accordingly.

In one embodiment of the invention conductor 40 was 10 mils wide, the radius of curves 42 was 50 mils, and the diameters of pads 43 was 60 mils: mercury wetted reed relays were used.

FIG. 4 shows an exploded view of relays 10 mounted on a strip-line configured printed circuit board denoted generally as 46 wherein the meander feedlines 40 have points of connection with relay terminals 15. Also shown are output lines 20, 21, 22, 60, 62, 64 and 66, which have individual points of connection with relay terminals 16. FIG. 4 also shows the sandwich structure detail of a typical strip-line configuration printed circuit board 46 utilizing the meander-line configuration for the feedline 40. The feedline 40 is sandwiched between two dielectric sheets 52 which are in turn clad with copper to form a groundplane 50. It can be appreciated by one skilled in the art that, except for terminal 13, the remaining relay terminals and corresponding solder pads are preferably electrically isolated from the groundplane 50.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. In a switching system for distribution of high speed digital pulses, in combination:

a plurality of relays each operable to complete a circuit between first and second switching contacts;

means mounting said relays with said first contacts mutually spaced in a first direction;

output lines connected individually to said second switching contacts;

a feed line including a meander conductor having first laterally spaced portions extending in said first direction and interconnected at smooth curves by second portions extending transverse to said first direction; and means connecting said feed line to said first switching contacts, consisting of solder pads located on said second portions and mutually spaced along said feed line, the mutual spacing along said feed line between said first switching contacts determining the relation between the loaded and unloaded impedances of said feed line.

2. In a switching system for distribution of high speed digital pulses, in combination:

a plurality of relays each operable to complete a circuit between first and second switching contacts;

means rigidly mounting said relays with said first contacts mutually spaced in a first direction;

output lines having a common ground plane and connected individually to said second switching contacts;

a feed line including said ground plane and a meander conductor having first laterally spaced portions extending in said first direction and interconnected at smooth curves by second portions extending transverse to said first direction; and means connecting said feed line to said first switching contacts, consisting of solder pads located on said second portions and mutually spaced along said feed line, the mutual spacing along said feed line between said first switching contacts determining the relation between the loaded and unloaded impedances of the feed line.

3. In a switching system for distribution of high speed digital pulses, in combination:

a plurality of relays each operable to complete a circuit between first and second switching contacts and having first lumped capacitances $C_1$ at said first contacts;

means mounting said relays with said first contacts mutually spaced in a first direction;

output lines connected individually to said second switching contacts;

a feed line including a meander connection having first laterally spaced parallel portions extending in said first direction and interconnected at smooth curves by second portions extending transverse to said first direction, said feed line having a distributed line capacitance $C_0$ and an unloaded impedance $Z_0$; and means connecting said feed line to said first switching contacts, consisting of solder pads with second lumped capacitances, $C_2$ located on said second portions and mutually spaced along said feed line by a common distance d, so that said feed line has a loaded impedance $Z_L$, the mutual spacing along said feed line between said first switching contacts determining the relation between the loaded and unloaded impedances of said feed line according to the equation, $$Z_L = \frac{Z_0}{\sqrt{1 + \frac{(C_1 + C_2)/d}{C_0}}}$$

* * * * *